US009297091B2

(12) United States Patent
Sakaida et al.

(10) Patent No.: US 9,297,091 B2
(45) Date of Patent: Mar. 29, 2016

(54) METHOD FOR PRODUCING ALUMINUM FILM AND METHOD FOR PRODUCING ALUMINUM FOIL

(71) Applicant: SUMITOMO ELECTRIC INDUSTRIES, LTD., Osaka-shi, Osaka (JP)

(72) Inventors: Hideaki Sakaida, Osaka (JP); Akihisa Hosoe, Osaka (JP); Junichi Nishimura, Osaka (JP); Kazuki Okuno, Osaka (JP); Koutarou Kimura, Osaka (JP); Kengo Goto, Osaka (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 6 days.

(21) Appl. No.: 14/371,482

(22) PCT Filed: Sep. 12, 2013

(86) PCT No.: PCT/JP2013/074620

§ 371 (c)(1),
(2) Date: Jul. 10, 2014

(87) PCT Pub. No.: WO2014/045986

PCT Pub. Date: Mar. 27, 2014

(65) Prior Publication Data

US 2014/0346050 A1 Nov. 27, 2014

(30) Foreign Application Priority Data

Sep. 18, 2012 (JP) ..... 2012-204037
Sep. 18, 2012 (JP) ..... 2012-204229

(51) Int. Cl.

| | |
|---|---|
| ***C25D 3/44*** | (2006.01) |
| ***C25D 21/14*** | (2006.01) |
| ***C25D 1/00*** | (2006.01) |
| ***C25D 1/04*** | (2006.01) |
| ***C25D 3/66*** | (2006.01) |

(52) U.S. Cl.
CPC *C25D 21/14* (2013.01); *C25D 1/00* (2013.01); *C25D 1/04* (2013.01); *C25D 3/665* (2013.01)

(58) Field of Classification Search
CPC ..... C25D 1/00; C25D 1/04; C25D 1/02; C25D 3/665; C25D 3/44; C25D 3/66; C25D 5/16; C25D 11/04; C25D 11/045; C25D 11/10; C25D 13/10; C25D 13/04; C25D 21/12; C25D 21/14
See application file for complete search history.

(56) References Cited

FOREIGN PATENT DOCUMENTS

| | | |
|---|---|---|
| JP | S62-124300 A | 6/1987 |
| JP | H01-104791 A | 4/1989 |

(Continued)

OTHER PUBLICATIONS

English Machine Translation of JP 2008-195990, A.*

*Primary Examiner* — J. Christopher Ball
(74) *Attorney, Agent, or Firm* — Drinker Biddle & Reath LLP

(57) ABSTRACT

A method for producing an aluminum film by electrodepositing aluminum on a base in an electrolytic cell to which a liquid electrolyte containing a molten salt is fed includes adjusting a concentration of an additive in such a manner that a measured value of an overvoltage is within a predetermined range on the basis of a predetermined relationship between the overvoltage and the concentration of the additive added to the molten salt upon electrodepositing aluminum in the liquid electrolyte.

7 Claims, 3 Drawing Sheets

(56) References Cited

FOREIGN PATENT DOCUMENTS

| | | | |
|---|---|---|---|
| JP | H01-138003 | A | 5/1989 |
| JP | 2000-345381 | A | 12/2000 |
| JP | 2011-216193 | A | 10/2011 |
| JP | 2012-144763 | A | 8/2012 |

* cited by examiner

METHOD FOR PRODUCING ALUMINUM FILM AND METHOD FOR PRODUCING ALUMINUM FOIL

TECHNICAL FIELD

The present invention relates to a method for producing an aluminum film and a method for producing aluminum foil.

BACKGROUND ART

Examples of a method for forming an aluminum film on a base include (i) physical vapor deposition (PVD) methods, such as vacuum deposition methods, sputtering methods, and laser ablation methods; (ii) paste coating methods, and (iii) plating methods.

(i) PVD Method

In a vacuum deposition method, for example, raw material aluminum is melted and evaporated by irradiating an aluminum alloy with an electron beam to deposit aluminum on a resin surface of a resin body having communicating pores, thereby forming an aluminum layer. In a sputtering method, for example, an aluminum target is subjected to plasma exposure to evaporate aluminum. The evaporated aluminum is deposited on a resin surface of a resin body having communicating pores, thereby forming an aluminum layer. In a laser ablation method, for example, an aluminum alloy is melted and evaporated by laser irradiation to deposit the aluminum alloy on a resin surface of a resin body having communicating pores, thereby forming an aluminum layer.

(ii) Paste Coating Method

In a paste coating method, for example, an aluminum paste in which an aluminum powder, a binding agent (binder), and an organic solvent are mixed together is used. The aluminum paste is applied onto a resin surface and then heated to eliminate the binder and the organic solvent simultaneously with the sintering of the aluminum paste. This sintering may be performed at a single operation or a plurality of operations. Alternatively, for example, the aluminum paste may be sintered simultaneously with the thermal decomposition of a resin body by applying the aluminum paste, heating the aluminum paste at a low temperature, and heating the aluminum paste with the aluminum paste immersed in a molten salt. Furthermore, this sintering is preferably performed in a non-oxidizing atmosphere.

(iii) Plating Method

Plating aluminum in an aqueous solution is practically almost impossible. Thus, an aluminum layer may be formed on a resin surface of a resin body having communicating pores by a molten salt electrolytic plating method in which aluminum is plated in a molten salt. In this case, aluminum is preferably plated in a molten salt after a resin surface of electrical conduction treatment in advance.

As the molten salt used for the molten salt electrolytic plating, a salt, for example, lithium chloride (LiCl), sodium chloride (NaCl), potassium chloride (KCl), or aluminum chloride ($AlCl_3$), may be used. Furthermore, salts containing two or more components may be mixed to form a eutectic molten salt. The eutectic molten salt advantageously has a low melting temperature. The molten salt is required to contain aluminum ions.

In the molten salt electrolytic plating, a multicomponent salt, such as $AlCl_3$—XCl (X: alkali metal)-$MCl_x$ (M is an additive element selected from Cr, Mn, and transition metal elements), is used. The salt is melted to prepare a plating liquid. A base is immersed therein and subjected to electrolytic plating, so that the base surface is plated with aluminum.

In the case where a base is composed of a non-conductive material, a base surface is subjected to electrical conduction treatment as a pretreatment in advance. Examples of the electrical conduction treatment include the plating of a conductive metal, such as nickel, on a resin surface by electroless plating; the coating of a conductive metal, such as aluminum, on a base surface by a vacuum deposition method or a sputtering method; and the application of a conductive paint containing conductive particles, such as carbon.

Conventionally, aluminum foil has been produced by rolling an aluminum strip. PTL 1 describes a method for producing aluminum foil by rolling. Specifically, as illustrated in FIG. 3, strips A and B coiled around take-up and supply reels 101, 102, 103, and 104 are rolled in two or more passes with a reversible rolling mill 105 equipped with work rolls 106 and back-up rolls 107 by passing the strips A and B through a nip between work rolls 106, thereby producing sheets of aluminum foil.

Aluminum foil has properties, such as thermal conductivity, moisture resistance, impermeability to air, lightness, and light-shielding capability and thus is used as a packaging material for various articles. In addition, aluminum foil is commonly used as a material for positive-electrode collectors of electrolytic capacitors and lithium-ion batteries because of its excellent electrical conductivity.

For example, in the case where aluminum foil is used for positive-electrode collectors of lithium-ion batteries, aluminum foil is used in the form of, for example, a stack or coil of multiple sheets of aluminum foil in order to increase battery capacity. PTL 2 relates to a negative electrode for a lithium secondary battery and discloses that copper foil is subjected to electrolytic plating to form a protruding portion on a surface of the copper foil.

Regarding copper foil used as an electrode material similarly to aluminum foil, a method is performed in which a film of copper plating is formed on a base by an electrolytic plating method, and then the film of plating is peeled from the base to produce copper foil. For example, PTL 3 discloses a method for producing copper foil used for a printed circuit board by electrodepositing copper on a cathode drum rotating in an electrolytic cell to which a liquid electrolyte is fed and separating copper foil from the cathode drum with the cathode drum rotating.

CITATION LIST

Patent Literature

PTL 1: Japanese Unexamined Patent Application Publication No. 1-138003

PTL 2: Japanese Unexamined Patent Application Publication No. 2011-216193

PTL 3: Japanese Unexamined Patent Application Publication No. 2000-345381

SUMMARY OF INVENTION

Technical Problem

Currently available aluminum foil is produced by a rolling method. The lower limit of the thickness of the currently available aluminum foil produced by the rolling method is about 15 μm. In the case of producing aluminum foil having a thickness of 5 μm to 10 μm with a rolling mill, the number of passes in a rolling process is increased to increase the cost, and it is physically difficult to produce it.

The use of aluminum foil having a rough surface as a positive-electrode collector increases charge capacity and battery capacity because the aluminum foil can hold a large amount of an active material. In the case of aluminum foil produced by a rolling method, however, a surface of the aluminum foil in contact with a working roll is a mirror-finished surface. Thus, even if the aluminum foil is used as a positive-electrode collector, the aluminum foil cannot hold a large amount of an active material. To enhance the battery capacity and reduce the size of a lithium ion battery, it is necessary to provide aluminum foil having a thickness as small as possible, preferably 10 μm or less, and having a rough surface.

In (i) PVD method and (ii) paste coating method described above, it is difficult to form an aluminum film having a rough surface or an aluminum film having a mirror surface, each of the surfaces having controlled surface roughness.

The present inventors have focused their attention on the fact that (iii) plating method described above has the potential of producing an aluminum film with a desired surface roughness by appropriately adjusting plating conditions. In the case where an aluminum film having a desired surface roughness is produced on a base, the separation of the aluminum film from the base results in aluminum foil having a rough surface or aluminum foil having a relatively smooth surface.

However, aluminum foil is not produced by an electrolytic plating method. There is no established method for producing an aluminum film having desired surface roughness. For example, there is a problem in which the surface roughness of a film cannot be controlled so as to have desired surface roughness just by forming the film on a base by conventional molten salt electrolysis.

In consideration of the foregoing problems, the present invention aims to provide a method for producing an aluminum film by an electrolytic plating method in such a manner that the aluminum film has a desired surface roughness and a method for producing aluminum foil.

Solution to Problem

The inventors have conducted intensive studies on a method for producing aluminum foil by forming an aluminum film on a base using a plating method with a molten salt serving as a liquid electrolyte and separating the base from the aluminum film and have accomplished the present invention.

To solve the foregoing problems, the present invention employs the following configuration.

(1) A method for producing an aluminum film by electrodepositing aluminum on a base in an electrolytic cell to which a liquid electrolyte containing a molten salt is fed includes adjusting a concentration of an additive in such a manner that a measured value of an overvoltage is within a predetermined range on the basis of a predetermined relationship between the overvoltage and the concentration of the additive added to the molten salt upon electrodepositing aluminum in the liquid electrolyte.

According to the present invention (1), an aluminum film having desired surface roughness can be produced by the electrolytic plating method.

(2) In the method for producing an aluminum film described in (1), the liquid electrolyte contains aluminum chloride and alkylimidazolium chloride, or aluminum chloride and alkylpyridinium chloride, and the number of carbon atoms in an alkyl group of each of the alkylimidazolium chloride and the alkylpyridinium chloride is in the range of 1 to 5.

According to the present invention (2), the aluminum film can be efficiently formed on the cathode base.

(3) In the method for producing an aluminum film described in (1) or (2), as the additive added to the molten salt, one or more selected from the group consisting of benzene, xylene, pyridine, pyrazine, benzotriazole, polystyrene, and 1,10-phenanthroline is added. According to the present invention (3), the aluminum film having uniform roughness can be formed on the cathode base.

(4) In the method for producing an aluminum film described in any one of (1) to (3), the molten salt is aluminum chloride-1-ethyl-3-alkylimidazolium chloride, and the additive is 1,10-phenanthroline.

According to the present invention (4), the aluminum film having uniform roughness can be formed on the cathode base.

(5) In the method for producing an aluminum film described in any one of (1) to (4), the aluminum film has a surface with an arithmetic mean roughness (Ra) of 0.2 μm to 0.5 μm or a ten-point mean roughness (Rz) of 1 μm to 5 μm.

In the case where the aluminum film having surface roughness obtained by the present invention (5) is formed into aluminum foil and used as a positive-electrode collector for a lithium ion battery or the like, the aluminum foil can hold a large amount of an active material, thereby enhancing the charge capacity and the battery capacity.

(6) In the method for producing an aluminum film described in (5), 1,10-phenanthroline is used as the additive, and the overvoltage is controlled in the range of 50 mV to 120 mV with a reference electrode, a counter electrode, and a working electrode that are configured to measure the overvoltage, the reference electrode and the counter electrode being composed of aluminum, and the working electrode being composed of platinum.

According to the present invention (6), the concentration of the additive added to the molten salt can be controlled to achieve an appropriate concentration.

(7) In the method for producing an aluminum film described in any one of (1) to (4), the additive is added to the molten salt, and the aluminum film has a mirror surface.

According to the present invention (7), the aluminum film having a mirror surface can be produced by the electrolytic method. Note that the term "mirror surface" used in the present invention indicates a surface having a surface roughness (arithmetic mean roughness: Ra) of 1.0 nm to 20.0 nm. In the present invention (7), the additive serves as a smoothing agent.

(8) In the method for producing an aluminum film described in (7), the aluminum film has a thickness of 0.5 μm or more and 10 μm or less.

According to the present invention (8), it is possible to produce aluminum foil that can be suitably used as a tab lead configured to extract electricity from inside a lithium ion battery, an electric double layer capacitor, or the like.

(9) In the method for producing an aluminum film described in (7) or (8), 1,10-phenanthroline is used as the additive, and the overvoltage is controlled in the range of 130 mV to 170 mV with a reference electrode, a counter electrode, and a working electrode that are configured to measure the overvoltage, the reference electrode and the counter electrode being composed of aluminum, and the working electrode being composed of platinum.

According to the present invention (9), the concentration of the additive added to the molten salt can be controlled to achieve an appropriate concentration.

(10) A method for producing aluminum foil includes separating the aluminum film from the base, the aluminum film being produced by the method for producing an aluminum film described in any one of (1) to (9).

According to the present invention (10), it is possible to produce aluminum foil having a rough surface or aluminum foil having a mirror surface.

(11) In the method for producing an aluminum foil described in (10), the aluminum foil has a thickness of 10 μm or less.

According to the present invention (11), aluminum foil suitably used as, for example, a positive-electrode collector for a lithium ion battery can be produced by the electrolytic plating method.

Advantageous Effects of Invention

According to the present invention, it is possible to produce an aluminum film by an electrolytic plating method in such a manner that the aluminum film has a desired surface roughness, and to produce aluminum foil.

DESCRIPTION OF EMBODIMENTS

Figure 1:
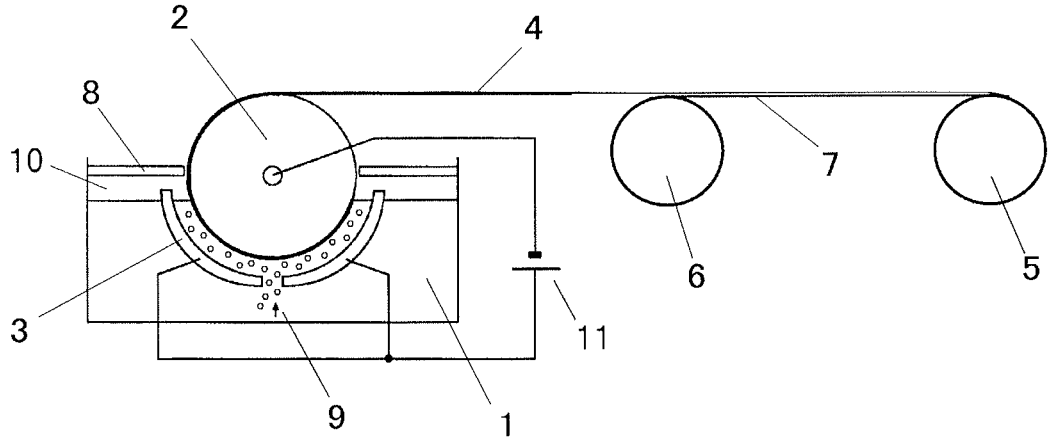
FIG. 1 illustrates an example of an apparatus for producing aluminum foil according to the present invention.

An aluminum film of the present invention is formed by electrodepositing aluminum on a base using molten salt electrolysis with a molten salt containing an adjusted component.

As the molten salt, an organic molten salt or an inorganic molten salt may be used. As the organic molten salt, an organic molten salt that is a eutectic salt of an organic halide and an aluminum halide may be used. As the organic halide, for example, an imidazolium salt or a pyridinium salt (for example, butylpyridinium chloride (BPC)) may be used.

Among these, the imidazolium salt is preferred. A salt containing an imidazolium cation with alkyl groups (each having 1 to 5 carbon atoms) at the 1- and 3-positions is preferably used. In particular, an aluminum chloride-1-ethyl-3-methylimidazolium chloride ($AlCl_3$-EMIC)-based molten salt is most preferably used because the molten salt has high stability, is not easily decomposed, and has a high electrical conductivity. A molten salt bath has a 10° C. to 100° C., preferably 25° C. to 80° C., and more preferably 30° C. to 60° C. At a higher temperature, a current density range in which plating is possible is extended. At 100° C. or lower, the heating cost is reduced, and the decomposition of the molten salt can be inhibited.

As the pyridinium salt, for example, butylpyridinium chloride (BPC) may be used.

As the inorganic molten salt, a eutectic salt of an alkali metal halide and an aluminum halide ($AlCl_3$—XCl (X: alkali metal)) may be used. Inorganic molten salts usually have high melting temperatures, compared with those of organic salt baths, such as an imidazolium salt bath. How ever, constraints imposed by environmental conditions, such as water and oxygen conditions, are small in number; hence, inorganic molten salts can be commercialized at low cost as a whole.

In the present invention, an additive is added to a molten salt as described below, in some cases. However, an inorganic molten salt has a high melting point, so the solution temperature of a plating solution needs to be increased. Furthermore, the additive may be evaporated or decomposed at a high temperature; hence, an organic molten salt, which is melted at a low temperature, is preferably used.

To produce an aluminum film having a surface with an arithmetic mean roughness (Ra) of 0.2 μm to 0.5 μm or a ten-point mean roughness (Rz) of 1 μm to 5 μm, in the case where the aluminum film has a small thickness, an additive, for example, benzene, xylene, pyridine, pyrazine, benzotriazole, polystyrene, or 1,10-phenanthroline, is preferably added to an molten salt.

In the case where the aluminum film has a large thickness, while the additive is not necessarily required, the addition of the additive provides the effect of achieving uniform roughness.

In the case where $AlCl_3$-EMIC is used as a molten salt, 1,10-phenanthroline is particularly preferably used. In the case where an aluminum film has a surface with an arithmetic mean roughness (Ra) of 0.2 μm to 0.5 μm or a ten-point mean roughness (Rz) of 1 μm to 5 μm and has a small thickness, the amount of the additive added to a plating bath is preferably 0.3 g/L or less.

To produce an aluminum film having a mirror surface, an additive serving as a smoothing agent needs to be added to a molten salt.

Examples of the additive include benzene, xylene, pyridine, pyrazine, benzotriazole, polystyrene, and 1,10-phenanthroline. These additives may be appropriately selected, depending on the type of molten salt.

In the case where $AlCl_3$-EMIC is used as a molten salt, 1,10-phenanthroline is particularly preferably used. To produce an aluminum film having a mirror surface, the amount of the additive added to a plating bath is preferably 0.3 g/L to 5.0 g/L. At 0.3 g/L or more, sufficient smoothness is provided. At 5.0 g/L or less, sufficient plating efficiency is provided.

The additive is partially taken in a film of plating during a plating process, thus reducing the concentration of the additive as the plating proceeds. To uniformize the degree of roughness of a surface of a film of plating, the concentration of the additive needs to be maintained in a predetermined range.

Thus, the concentration of the additive is required to be monitored. In the present invention, an overvoltage is measured, and the additive is added to the molten salt on the basis of a value obtained by the measurement in such a manner that the overvoltage is within a predetermined range. The monitoring may be continuously or intermittently performed.

The overvoltage is defined as the absolute value of the difference between electrode potential at the time of the actual initiation of the electrodeposition reaction of aluminum and theoretical potential (equilibrium electrode potential) in which the electrodeposition reaction of aluminum occurs. The absolute value of the potential difference reflects the concentration of the additive. Thus, the concentration of the additive can be controlled by adjusting the amount of the additive added in such a manner that the overvoltage is within a predetermined range.

Figure 4:
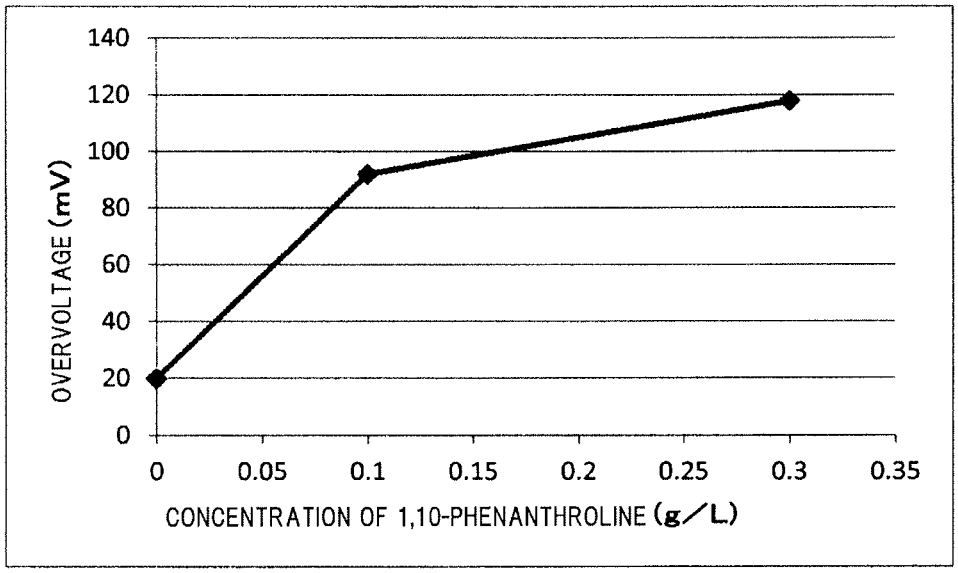
FIG. 4 illustrates the relationship between the overvoltage and the concentration of an additive when 1,10-phenanthroline is used as the additive.
Figure 5:
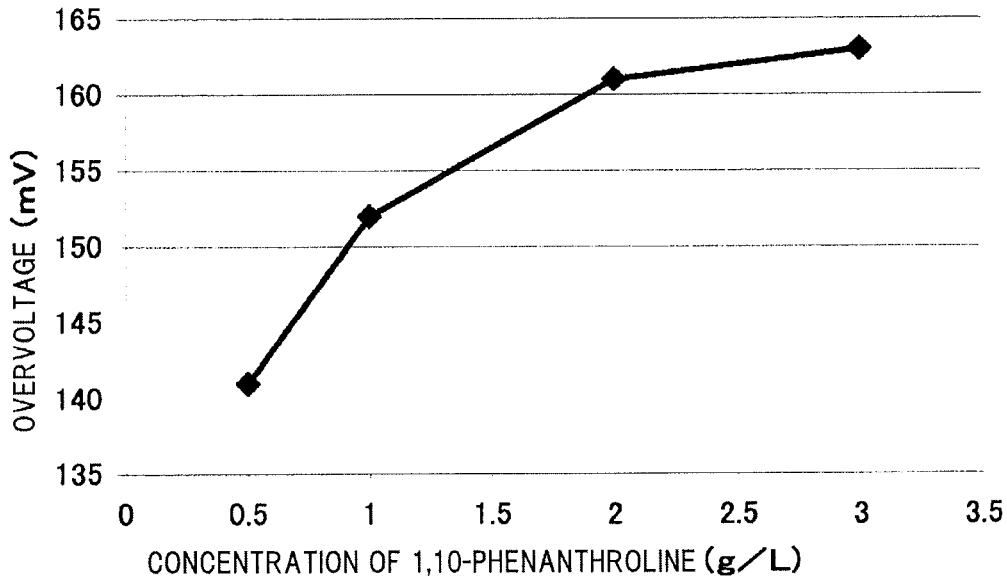
FIG. 5 illustrates the relationship between the overvoltage and the concentration of an additive when 1,10-phenanthroline is used as the additive.

FIGS. 4 and 5 each illustrate the relationship between the overvoltage and the concentration of an additive, in which the overvoltage is measured using $AlCl_3$-EMIC as a molten salt, 1,10-phenanthroline as the additive, a reference electrode and a counter electrode each composed of aluminum, and a working electrode composed of platinum, these electrodes being used for the measurement of the overvoltage. The relationship between the overvoltage and the concentration of the additive when the working electrode is composed of a material other than platinum is different from the relationship between the overvoltage and the concentration of the additive when the working electrode is composed of platinum. Thus, the relationship between the overvoltage and the concentration of the additive is required to be determined, depending on the type of material used for the electrode.

In the case where an aluminum film having a surface with an arithmetic mean roughness (Ra) of 0.2 μm to 0.5 μm or a ten-point mean roughness (Rz) of 1 μm to 5 μm is produced using $AlCl_3$-EMIC as a molten salt, 1,10-phenanthroline as an additive, a reference electrode and a counter electrode each composed of aluminum, and a working electrode composed of platinum, these electrodes being used for the measurement of the overvoltage, an additive concentration such that the overvoltage is in the range of 0 mV to 120 mV is preferred. In particular, in order to suppress dendritic growth on a surface of the aluminum film, the overvoltage is more preferably in the range of 50 mV to 120 mV. However, even if the overvoltage is less than 50 mV, the foregoing surface roughness can be obtained.

In the case where an aluminum film having a mirror surface is produced using $AlCl_3$-EMIC as a molten salt, 1,10-phenanthroline as an additive, a reference electrode and a counter electrode each composed of aluminum, and a working electrode composed of platinum, these electrodes being used for the measurement of the overvoltage, an additive concentration such that the overvoltage is 130 mV or more is preferred. However, when the overvoltage is more than 170 mV, a surface of the aluminum film begins to blacken. Thus, the additive concentration such that the overvoltage is in the range of 130 mV to 170 mV is preferred.

Figure 6:
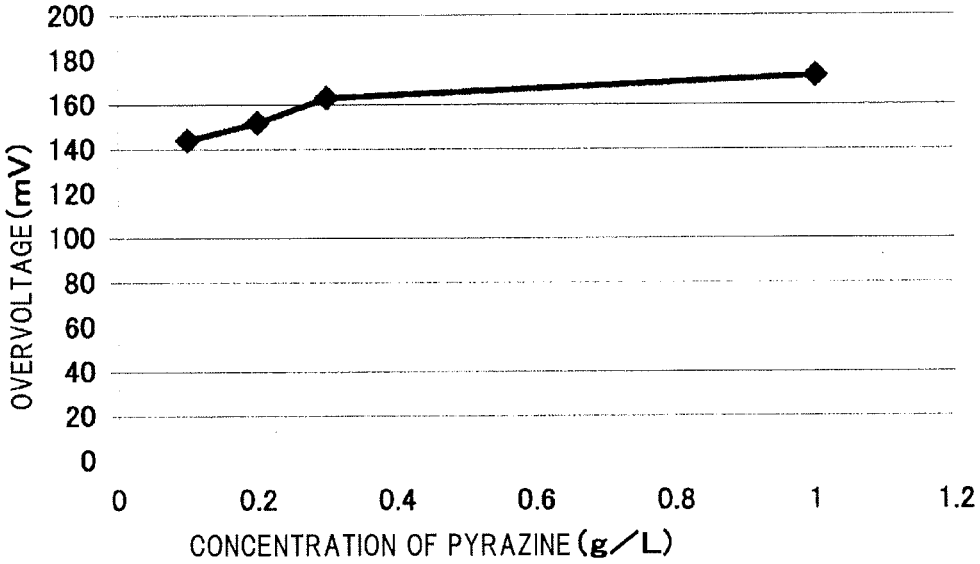
FIG. 6 illustrates the relationship between the overvoltage and the concentration of an additive when pyrazine is used as the additive.

FIG. 6 illustrates the relationship between the overvoltage and the concentration of an additive when $AlCl_3$-EMIC is used as a molten salt and pyrazine is used. In the case where an aluminum film having a mirror surface is produced using $AlCl_3$-EMIC as a molten salt, pyrazine as an additive, a reference electrode and a counter electrode each composed of aluminum, and a working electrode composed of platinum, these electrodes being used for the measurement of the overvoltage, an additive concentration such that the overvoltage is in the range of 140 mV to 180 mV is preferred.

Aluminum foil is formed by forming an aluminum film on a base and removing the base. Any material may be used as the base as long as it can be separated from the aluminum film in a subsequent step. The choice of aluminum as the base facilitates the separation of the aluminum film because of the poor adhesion of the aluminum film to the aluminum base by virtue of the common presence of aluminum oxide on an aluminum surface.

In the case where a resin that has been subjected to electrical conduction treatment is used as a base, the resin is removed by thermal decomposition or the like after plating to provide aluminum foil. In the case where a base composed of nickel is selected, nickel is removed by dissolution with concentrated nitric acid to provide aluminum foil. The base preferably has an endless belt-like or drum-like shape because aluminum foil can be continuously produced.

FIG. 1 illustrates an example of an apparatus used for a method for producing aluminum foil according to the present invention. An electrolytic cell 1 contains a liquid electrolyte containing a molten salt.

A cylindrical cathode drum (feed drum) 2 is rotatably arranged in the electrolytic cell 1. Electrolytic anodes (aluminum plates) 3 are arranged along the cathode drum 2 with a substantially constant distance kept from the drum. The liquid electrolyte is fed between the cathode drum 2 and the electrolytic anodes 3.

A voltage such that aluminum is electrodeposited from the liquid electrolyte is applied between the cathode drum 2 and the electrolytic anodes 3 with a rectifier 11. As a result, aluminum is electrodeposited on a surface of the rotating cathode drum 2 to form an aluminum film. The thickness of the aluminum film electrodeposited on the drum surface increases as the drum rotates. The aluminum film having a predetermined thickness is continuously separated from the drum to provide aluminum foil 4. The aluminum foil 4 is taken up on a take-up roll 5. At this time, in the case where the aluminum foil 4 is thin, the aluminum foil may be stacked on an auxiliary film 7 unwound from an auxiliary film roller 6 and taken up on the take-up roll 5.

Figure 2:
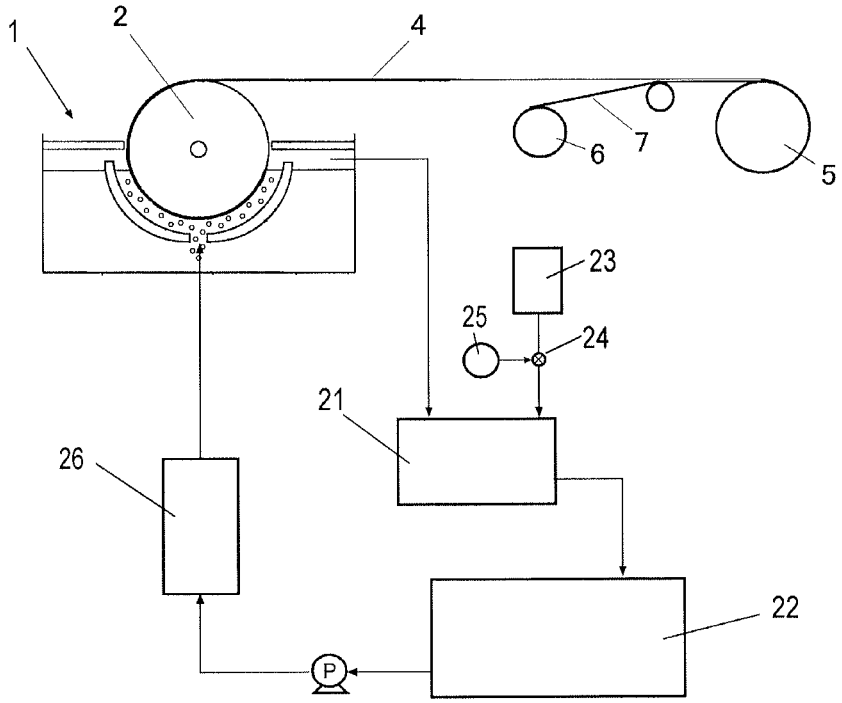
FIG. 2 illustrates an example of an apparatus for producing aluminum foil according to the present invention.
Figure 3:
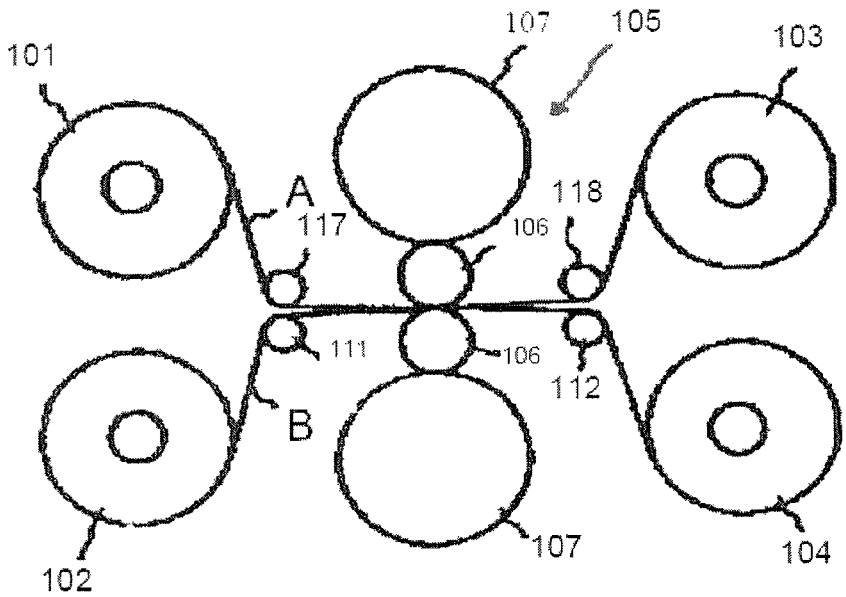
FIG. 3 illustrates an example of an apparatus for producing copper foil by rolling.

As illustrated in FIG. 2, the liquid electrolyte which is fed between the cathode drum 2 and the electrolytic anodes 3 and in which the amount of the additive is reduced by electrodeposition is overflowed from the electrolytic cell 1, continuously returned to a recovery electrolyte tank 21, and sent to a replenisher storage tank 22. An additive storage tank 23 is connected to the recovery electrolyte tank 21. A supply valve 24 is controlled by a control signal from a controller 25 configured to send a control signal on the basis of an overvoltage signal. A predetermined amount of the additive is fed from the additive storage tank 23 into the recovery electrolyte tank 21 to adjust the concentration of the additive. Then the liquid electrolyte is fed from the replenisher storage tank 22 to a filter 26 and filtered to remove solids. The filtrate is fed into the electrolytic cell 1. Furthermore, the temperature of the liquid electrolyte is increased by electrolysis; hence, the liquid electrolyte may be cooled with a cooling device. The electrolytic plating as described above is performed in the molten salt to form a layer of aluminum plating on the surface of the cathode drum 2, the layer having a uniform thickness.

To measure the overvoltage, a reference electrode, a counter electrode, and a working electrode are provided in the electrolytic cell 1 to prepare an electrochemical measurement system with a three-electrode cell. A potential at which aluminum begins to precipitate when a voltage is applied to the working electrode with respect to the reference electrode, that is, a potential at which a current begins to flow, is measured. This voltage may be defined as an overvoltage. The reference electrode and the counter electrode may be composed of aluminum. The working electrode may be composed of, for example, platinum, glassy carbon, gold, silver, copper, nickel, or the like. The relationship between the overvoltage and the concentration of the additive when the working electrode is composed of a material other than platinum is different from the relationship between the overvoltage and the concentration of the additive when the working electrode is composed of platinum. Thus, the relationship between the overvoltage and the concentration of the additive is required to be determined, depending on the type of material used for the electrode.

When the value of the overvoltage is outside the set range, the opening of the supply valve 24 for the additive is adjusted to control the amount of the additive fed to the replenisher storage tank 22.

The contamination of the molten salt with water or oxygen causes problems of the degradation of the molten salt and plating failure. Thus, the electrolysis is preferably performed in an inert gas atmosphere, for example, nitrogen or argon, under a hermetically sealed environment.

In the apparatus illustrated in FIG. 1, an inert gas 9 is bubbled from the bottom of the electrolytic cell 1 while a surface of the plating bath of the electrolytic cell 1 is covered with a lid 8, thereby stirring the liquid electrolyte, removing water and oxygen in the liquid electrolyte, and filling a space 10 on a surface of the liquid electrolyte with a nitrogen gas atmosphere. This results in a narrow range of the space 10 where the inert gas atmosphere is maintained, thus reducing the cost of the inert gas.

Instead of the lid 8, a shielding plate may be floated on the surface of the liquid electrolyte to prevent the entrance of outside air. The inert gas may be fed from above the electrolytic cell 1.

In an aluminum plating method according to the present invention, electroplating is preferably performed while the temperature of the plating bath is adjusted to 10° C. to 100° C. A temperature of the plating bath of 10° C. or higher results in sufficiently low viscosity and resistance of the plating bath, thus extending the range of current density. A temperature of the plating bath of 100° C. or lower results in suppression of the evaporation of aluminum chloride. The temperature of the plating bath is more preferably in the range of 25° C. to 80° C. and still more preferably 30° C. to 60° C.

A material for the cathode drum 2 used in the aluminum plating method according to the present invention is not particularly limited. For example, aluminum, copper, or iron may be preferably used.

Aluminum foil having a surface with an arithmetic mean roughness (Ra) of 0.2 μm to 0.5 μm or a ten-point mean roughness (Rz) of 1 μm to 5 μm may be preferably used not only for the normal use of aluminum foil but also as a collector for lithium ion batteries, electrolytic capacitors, electric double layer capacitors, and lithium ion capacitors.

Aluminum foil with a mirror surface may be preferably used not only for the normal use of aluminum foil but also as a tab lead configured to extract electricity from inside a lithium ion battery sheathed with an aluminum laminated film, an electrolytic capacitor, an electric double layer capacitor, a lithium ion capacitor, and so forth. The tab lead is welded to a collector by, for example, ultrasonic welding. The aluminum foil with a mirror surface may be used as a tab lead because better contact properties are preferred.

EXAMPLES

The present invention will be described in more detail below on the basis of examples. These examples are illustrative, and a method for producing an aluminum film is not limited to these examples. The scope of the invention is shown by the claims and includes any modifications within the scope and meaning equivalent to the scope of the claims.

Example 1-1

An apparatus for producing electrolytic aluminum foil as illustrated in FIG. 1 was used. The cathode drum 2 which was composed of aluminum and which had a diameter of 0.25 m was connected to the cathode side of the rectifier 11. Aluminum plates serving as counter electrodes (purity: 99.99%) were connected to the anode side. Plating was performed under electrolysis conditions described below while nitrogen was bubbled from the bottom of the electrolytic cell 1 at a flow rate of 5 L/min. The resulting film of aluminum plating was continuously separated from the cathode drum 2 to provide electrolytic aluminum foil having a thickness of 8 μm. A reference electrode and a counter electrode each composed of aluminum were used, and a working electrode composed of platinum was used, each of the electrodes being used for the measurement of an overvoltage.

The electrolysis conditions are as follows:

Composition of molten salt: 33 mol % EMIC-67 mol % $AlCl_3$

Additive: no

Liquid temperature: 45° C.

Current density: 6 A/dm$^2$ (direct current)

Set overvoltage: 20 mV

Measurement of surface roughness of the resulting electrolytic aluminum foil at the center portion in the width direction and end portions in the width direction demonstrated that the surface roughness was large at the center portion in the width direction, compared with the ends portion in the width direction.

Example 1-2

Composition of molten salt: 33 mol % EMIC-67 mol % $AlCl_3$

Additive: no

Liquid temperature: 45° C.

Current density: 6 A/dm$^2$ (direct current)

Set overvoltage: 20 mV

In EXAMPLE 1-2, aluminum foil was formed in the same way as in EXAMPLE 1-1. Regarding the surface roughness of the electrolytic aluminum foil in EXAMPLE 1-2, only the arithmetic mean roughness was measured without specifying the measurement point.

Example 2

Composition of molten salt: 33 mol % EMIC-67 mol % $AlCl_3$

Additive: 1,10-phenanthroline

Liquid temperature: 45° C.

Current density: 6 A/dm$^2$ (direct current)

Set overvoltage: 90 mV to 120 mV

In EXAMPLE 2, aluminum foil was formed in the same way as in EXAMPLE 1-1, except that 1,10-phenanthroline was added as an additive and that the concentration of the additive was adjusted in such a manner that the set overvoltage was 90 mV to 120 mV. Measurement of surface roughness of the resulting electrolytic aluminum foil at the center portion in the width direction and end portions in the width direction demonstrated that the surface roughness was substantially comparable in each of the end portions in the width direction and the center portion in the width direction.

Example 3-1

Composition of molten salt: 33 mol % EMIC-67 mol % $AlCl_3$

Additive: 1,10-phenanthroline

Liquid temperature: 45° C.

Current density: 6 A/dm$^2$ (direct current)

Set overvoltage: 130 mV

In EXAMPLE 3-1, aluminum foil was formed in the same way as in EXAMPLE 1-1, except that 1,10-phenanthroline was added as an additive and that the concentration of the additive was adjusted in such a manner that the set overvoltage was 120 mV or more. Here, the set overvoltage was 130 mV.

Example 3-2

Composition of molten salt: 33 mol % EMIC-67 mol % $AlCl_3$

Additive: 1,10-phenanthroline

Liquid temperature: 45° C.

Current density: 6 A/dm$^2$ (direct current)

Set overvoltage: 130 mV to 160 mV

In EXAMPLE 3-2, aluminum foil was formed in the same way as in EXAMPLE 3-1, except that the concentration of the additive was adjusted in such a manner that the set overvoltage was 130 mV to 160 mV. Regarding the surface roughness of the electrolytic aluminum foil in EXAMPLE 3-2, only the arithmetic mean roughness was measured without specifying the measurement point.

Example 4

Composition of molten salt: 33 mol % EMIC-67 mol % $AlCl_3$

Additive: pyrazine

Liquid temperature: 45° C.

Current density: 6 A/dm$^2$ (direct current)

Set overvoltage: 140 mV to 180 mV

In EXAMPLE 4, aluminum foil was formed in the same way as in EXAMPLE 1-1, except that pyrazine was added as an additive and that the concentration of the additive was adjusted in such a manner that the set overvoltage was 140 mV to 180 mV. Regarding the surface roughness of the electrolytic aluminum foil in EXAMPLE 4, only the arithmetic mean roughness was measured without specifying the measurement point.

Evaluation

Table describes the surface roughness of the aluminum foil formed in EXAMPLES 1-1 to 4.

TABLE

| | Additive | Set over-voltage (mV) | Arithmetic mean roughness (Ra) (μm) Center portion in width direction | Arithmetic mean roughness (Ra) (μm) End portion in width direction | Ten-point mean roughness (Rz) (μm) Center portion in width direction | Ten-point mean roughness (Rz) (μm) End portion in width direction |
|---|---|---|---|---|---|---|
| EXAMPLE 1-1 | no | 20 | 0.671 | 0.342 | 3.730 | 2.660 |
| EXAMPLE 1-2 | no | 20 | 0.328 | | — | — |
| EXAMPLE 2 | 1,10-phenanthroline | 90~120 | 0.283 | 0.257 | 1.884 | 1.882 |
| EXAMPLE 3-1 | 1,10-phenanthroline | 130 | 0.022 | 0.018 | 0.134 | 0.138 |
| EXAMPLE 3-2 | 1,10-phenanthroline | 130~160 | 0.0188 | | — | — |
| EXAMPLE 4 | pyrazine | 140~180 | 0.0162 | | — | — |

REFERENCE SIGNS LIST

FIGS. 1 and 2

1 electrolytic cell
2 cathode drum
3 electrolytic anode
4 aluminum foil
5 take-up roll
6 auxiliary film roller
7 auxiliary film
8 lid
9 inert gas
10 space
11 rectifier
21 recovery electrolyte tank
22 replenisher storage tank
23 additive storage tank
24 supply valve
25 controller
26 filter

FIG. 3

101 to 104 take-up and supply reel
105 reversible rolling mill
106 work roll
107 back-up roll
111, 112, 117, 118 deflector roll
A, B strip

The invention claimed is:

1. A method for producing an aluminum film by electrodepositing aluminum on a base in an electrolytic cell to which a liquid electrolyte containing a molten salt is fed, comprising:

adjusting a concentration of an additive in such a manner that a measured value of an overvoltage is within a predetermined range on the basis of a predetermined relationship between the overvoltage and the concentration of the additive added to the molten salt upon electrodepositing aluminum in the liquid electrolyte wherein the aluminum film has a surface with an arithmetic mean roughness (Ra) of 0.2 μm to 0.5 μm or a ten-point mean roughness (Rz) of 1 μm to 5 μm.

2. The method for producing an aluminum film according to claim 1, wherein 1,10-phenanthroline is used as the additive, and the overvoltage is controlled in the range of 50 mV to 120 mV with a reference electrode, a counter electrode, and a working electrode that are configured to measure the overvoltage, the reference electrode and the counter electrode being composed of aluminum, and the working electrode being composed of platinum.

3. A method for producing an aluminum film by electrodepositing aluminum on a base in an electrolytic cell to which a liquid electrolyte containing a molten salt is fed, comprising:

adjusting a concentration of an additive in such a manner that a measured value of an overvoltage is within a predetermined range on the basis of a predetermined relationship between the overvoltage and the concentration of the additive added to the molten salt upon electrodepositing aluminum in the liquid electrolyte, wherein the additive is added to the molten salt, and the aluminum film has a mirror surface.

4. The method for producing an aluminum film according to claim 3, wherein the aluminum film has a thickness of 0.5 μm or more and 10 μm or less.

5. The method for producing an aluminum film according to claim 3, wherein 1,10-phenanthroline is used as the additive, and the overvoltage is controlled in the range of 130 mV to 170 mV with a reference electrode, a counter electrode, and a working electrode that are configured to measure the overvoltage, the reference electrode and the counter electrode being composed of aluminum, and the working electrode being composed of platinum.

6. A method for producing aluminum foil, comprising separating the aluminum film from the base, the aluminum film being produced by a method for producing an aluminum film by electrodepositing aluminum on a base in an electrolytic cell to which a liquid electrolyte containing a molten salt is fed, comprising:

adjusting a concentration of an additive in such a manner that a measured value of an overvoltage is within a predetermined range on the basis of a predetermined relationship between the overvoltage and the concentration of the additive added to the molten salt upon electrodepositing aluminum in the liquid electrolyte.

7. The method for producing aluminum foil according to claim 6, wherein the aluminum foil has a thickness of 10 μm or less.

* * * * *